United States Patent [19]

Grooss et al.

[11] 4,162,872

[45] Jul. 31, 1979

[54] LIFT ARM ASSEMBLY

[75] Inventors: Frank A. Grooss, Morton; Gerald P. Simmons, Washington, both of Ill.

[73] Assignee: Caterpillar Tractor Co., Peoria, Ill.

[21] Appl. No.: 859,362

[22] Filed: Dec. 13, 1977

[51] Int. Cl.[2] ..... E02F 3/82

[52] U.S. Cl. ..... 414/713; 414/727

[58] Field of Search ..... 214/140, 769, 770, 776, 214/778, 145 R

[56] References Cited

U.S. PATENT DOCUMENTS

| | | | |
|---|---|---|---|
| 2,610,754 | 9/1952 | Inskeep | 214/145 |
| 3,363,792 | 1/1968 | Hoppe | 214/776 |
| 3,606,061 | 9/1971 | Molby | 214/776 |
| 3,722,864 | 3/1973 | Borer | 254/124 |
| 3,884,378 | 5/1975 | Muellner | 214/769 |
| 4,006,834 | 2/1977 | Anderson | 214/776 |

*Primary Examiner*—Trygve M. Blix
*Assistant Examiner*—George F. Abraham
*Attorney, Agent, or Firm*—Wegner, Stellman, McCord, Wiles & Wood

[57] ABSTRACT

A low-profile front end loader vehicle has the bucket located as close to the front wheels as is possible without sacrificing strength and maneuverability. The lift arms are shortened and reshaped in the midportion to lower the low position of the lift arms. An irregularly shaped reinforced tubular crossbrace is provided and has end plates which coact not only with external plates on each arm for attachment of the lift cylinders to said arms, but also coact with brackets carried by said crossbrace to support the tilt arms thereon. The respective plates strengthen the lift arms and the reinforced crossbrace has internal stiffness that resists torsion and bending to provide an improved compact lift structure.

14 Claims, 9 Drawing Figures

LIFT ARM ASSEMBLY

BACKGROUND OF THE INVENTION

1. FIELD OF THE INVENTION

This invention relates to front end loader vehicles and, more particularly, to an improved lift structure for a low-profile front end loader for use in mines or other low clearance locations.

2. DESCRIPTION OF THE PRIOR ART

Front end loaders have been known for some time and have, in general, been provided with various combinations of lift arms, tilt arms and cylinders to operate same to tilt a bucket once it is loaded, to raise the loaded bucket, to dump the raised loaded bucket and to return the bucket to the level reloading position. Since most front end loaders were not concerned with compactness or low profile of the vehicle, the lift and tilt arms were made as massive as was necessary and the pivots were located where convenient to accomplish the motions desired.

SUMMARY OF THE INVENTION

The present invention is directed to overcoming one or more of the problems as set forth above.

According to the present invention, a low-profile front end loader is provided with a redesigned lift arm structure having a pair of shaped lift arms pivotally connected to a tower on the loader and being rigidly connected together by an irregularly shaped tubular crossbrace which has end plates connected to the respective lift arms. Mating plates are connected on the opposite sides of the lift arms in alignment with the end plates on the crossbrace so as to provide a pair of bearing supports for one end of the lift cylinders. The crossbrace is provided with internal reinforcements in alignment with brackets on the exterior side thereof, which brackets combine with the end plates to support the tilt arms. The tilt arms are connected to tilt cylinders carried by the towers. The tilt arms and the lift arms are connected to the bucket so as to provide the bucket with the appropriate tilting and lifting functions.

The crossbrace has internal webs and stiffeners which resist torsion and bending of the crossbrace. The end plates on the crossbrace, together with the external plates on the lift arms, strengthen the narrowest points of the arms and serve as the connection for the lift cylinders.

The improved assembly provides a rigid lift arm structure which makes it possible to maneuver the bucket in all desirable motions while maintaining a low profile and the structural integrity of the vehicle.

BRIEF DESCRIPTION OF THE DRAWING

The details of construction and operation of the invention are more fully described with reference to the accompanying drawing which forms a part hereof and in which like reference numerals refer to like parts throughout.

In the drawing.

DESCRIPTION OF THE PREFERRED EMBODIMENT

Figure 1:
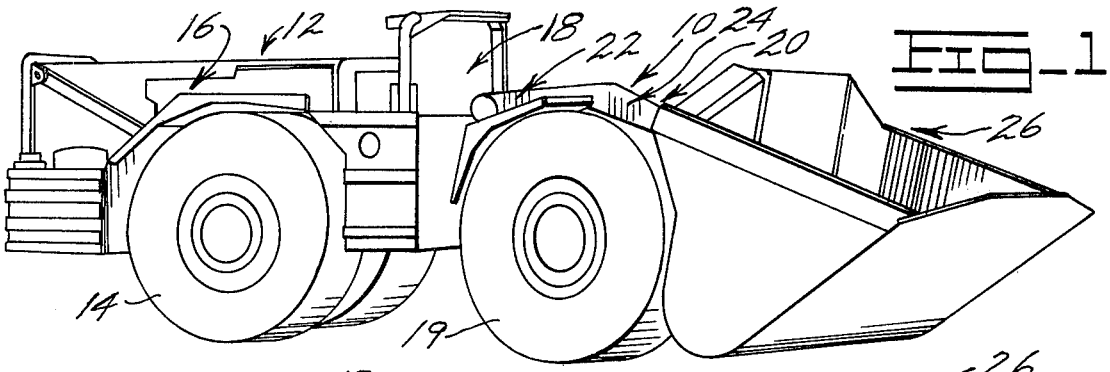
FIG. 1 is an elevational view of an improved low-profile front end loader vehicle incorporating the features of the invention.

In the drawing, FIG. 1 illustrates a low-profile front end loader-type vehicle 10 and includes a rear portion 12 mounted on a pair of wheels 14 and containing a prime mover 16 and an operator's cab 18. The vehicle 10 has a front portion 20 mounted on wheels 19 and articulated relative to the rear portion 12. The front portion 20 has a frame 21 upon which is mounted a tower structure 22 for supporting a lift and tilt assembly 24 connected to a bucket 26 for lifting and tilting same.

Figure 2:
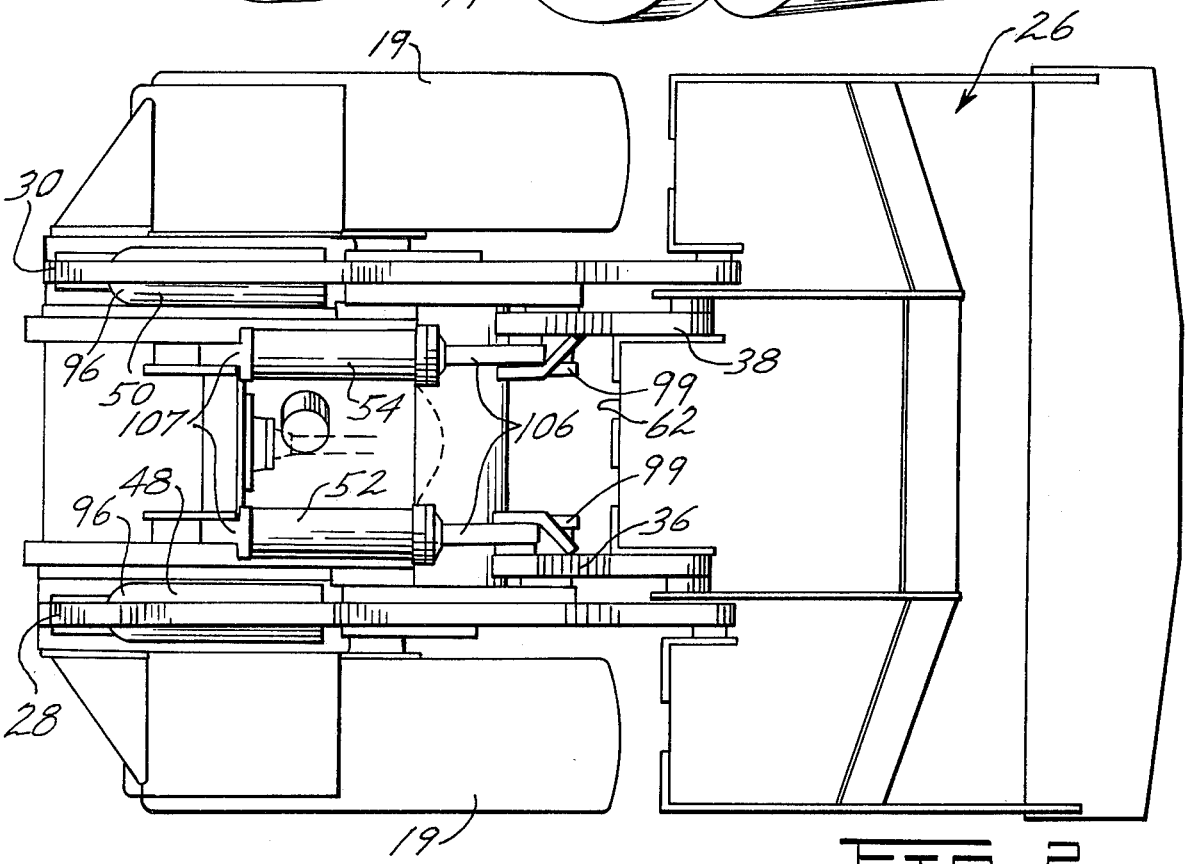
FIG. 2 is a top plan view of the front end portion of the vehicle of FIG. 1 showing some of the features of the invention.
Figure 3:
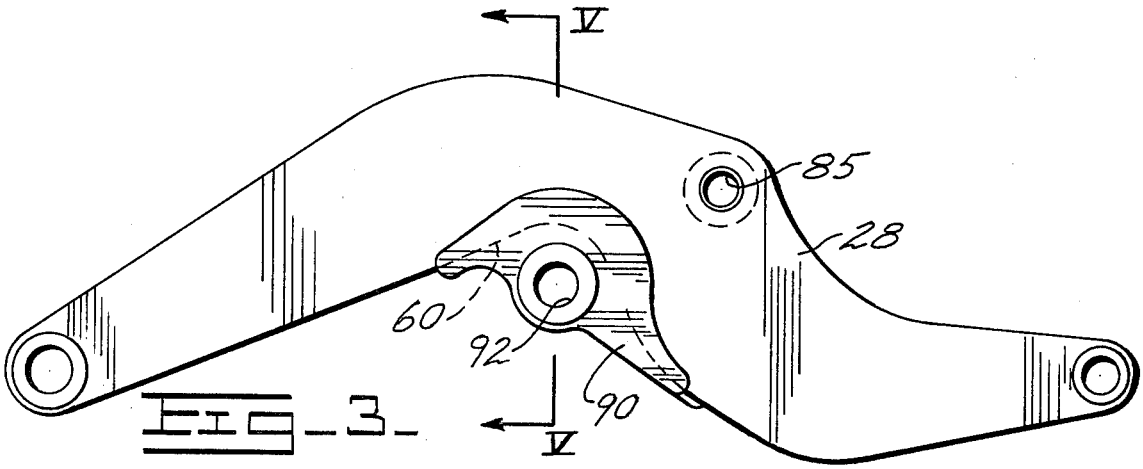
FIG. 3 is an enlarged elevational view of the lift arm of the invention.
Figures 8, 9:
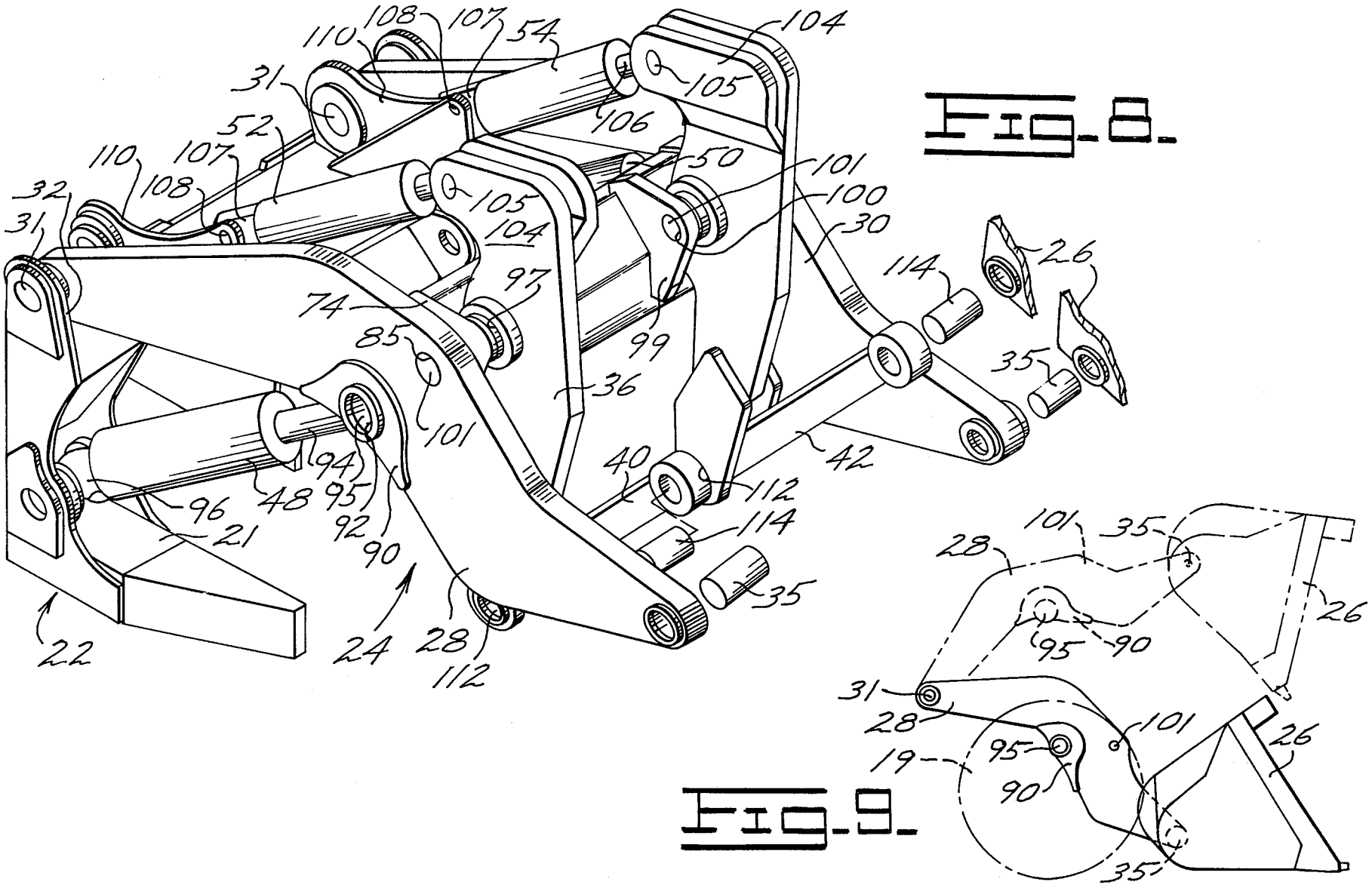
FIG. 8 is a perspective view of a tilt link structure connected to a tower of the front loader vehicle; and, FIG. 9 is a schematic view of the lift arm and bucket in the down and raised positions.

Referring to FIGS. 2 and 8, the lift and tilt assembly 24 has lift arms 28 and 30 pivoted at one end portion to the upper portion 32 of the tower structure 22 and pivoted at the other end portion to the lower rear portions of the bucket 26. The assembly 24 also includes the tilt arms 36 and 38 which are pivoted to the midportion of the lift arms 28 and 30 and are connected at one end portion through links 40 and 42, respectively, to the upper rear portions of the bucket 26. Lift cylinders 48 and 50 extend between the lower portions of the towers 22 and the midportions of the lift arms 28 and 30 for raising and lowering the lift and tilt assembly 24 and the bucket 26. Tilt cylinders 52 and 54 extent between arms on the upper portions of the towers 22 and between the upper portions of the tilt arms 36 and 38 for tilting the bucket 26 about the mounting of the bucket to the lift arms 28 and 30.

In order to provide adequate clearance and to locate the bucket 26 as close to the front wheels 19 and to the tower structure 22 as is possible and to make it possible to tilt the bucket substantially about the axis of the connection between the lift arms 28,30 and the bucket, the lift arms 28 and 30 were shortened and changed in shape and the locations of the connections between the lift arms and tilt arms were changed. The bulk of the tilt arms 28,30 was reduced, cutting out a portion 60 at the midportion of each arm about which is connected the end plates 74,76 of an irregularly shaped tubular crossbrace 62 extending between the lift arms 28 and 30.

Figure 5:
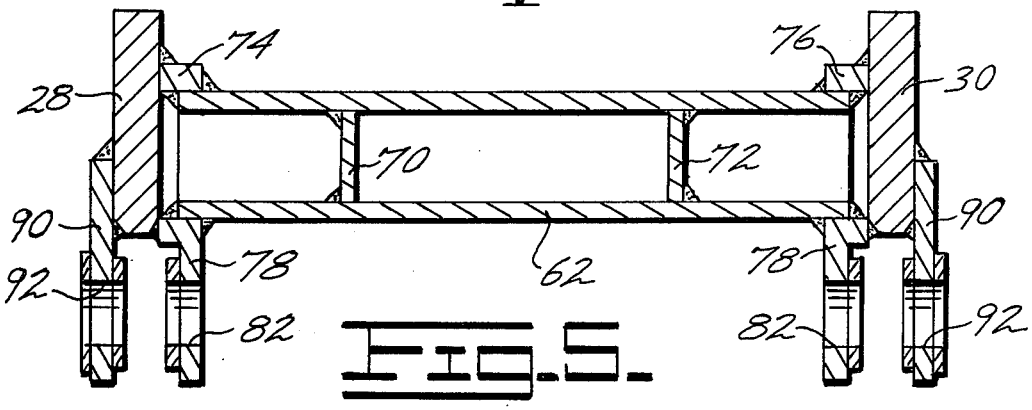
FIG. 5 is a cross-sectional view taken along the line 5—5 of FIG. 4.
Figure 6:
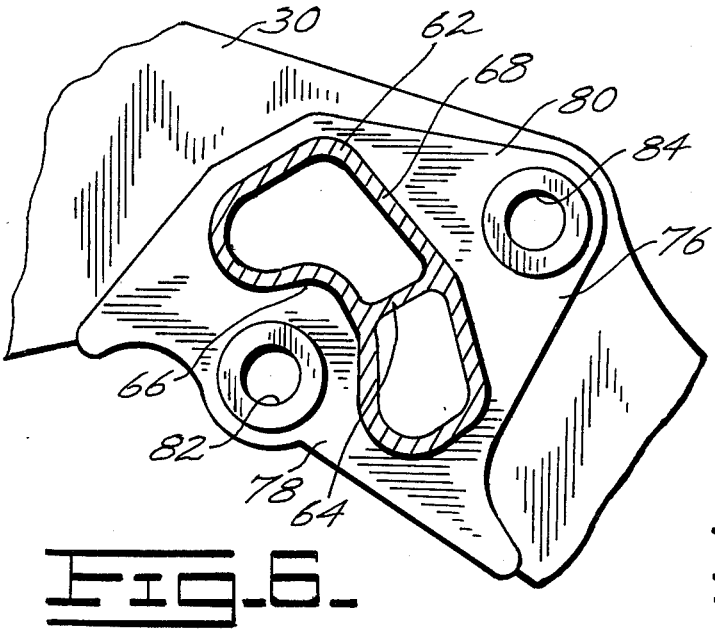
FIG. 6 is a cross-sectional view taken along the line 6—6 of FIG. 4.
Figure 7:
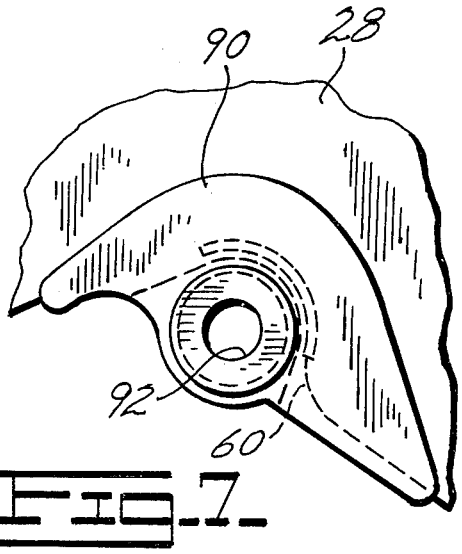
FIG. 7 is a side elevational view taken along the line 7—7 of FIG. 4.

The crossbrace 62, as can be seen in FIG. 6, is irregularly shaped in cross section and has a reinforcing web 64 extending longitudinally from one end to the other thereof. The web 64 supports the longer spaced apart side walls 66 and 68 of said crossbrace 62. As shown in FIG. 5, a pair of spaced apart internal stiffeners or braces 70 and 72 extend transverse to the longitudinal axis of the crossbrace 62 and transverse to the longitudinal web 64 so as to support the walls 66 and 68 in the direction transverse to the longitudinal axis of said crossbrace. The ends of the crossbrace 62 have the ends plates 74 and 76 welded, or otherwise secured thereto with each of said end plates 74 and 76 having portions 78 and 80 outwardly extending from said crossbrace 62. An opening 82 is formed in portion 78 and an opening 84 is formed in portion 80 with the opening 84 in end plate 74 aligning with opening 85 in lift arm 30 and opening 84 in end plate 76 aligning with opening 85 in lift arm 28. The end plates 74 and 76 are rigidly secured to the lift arms 28 and 30 with the openings 82 aligned with the cut out portions 60 in the respective arms.

A teardrop-shaped external plate 90 is secured, as by welding or the like, to the external surface of the respective arms 28 and 30 about the cut outs 60 in said arms with each plate 90 having an aperture 92 formed therethrough, which aperture 92 aligns with the apertures 82 in the end plates 74 and 76 of the crossbrace 62. Each external plate 90 is spaced from the end plates 74,76, see FIG. 5, with the rod ends 94 of the lift cylinders 48 and 50 pivotally connected by pins 95 to said plates 90,74 and 90,76. Said pins 95 extend between the openings 92 in plate 90 and opening 82 in plates 74,76 with the cylinder end 96 of the lift cylinders 48 and 50 being pivotally connected to the lower portion of the tower 22. The other end portions of the lift arms 28,30 are pivotally mounted by pins 35 to the lower rear portion of the bucket 26. Activation of the lift cylinders 48 and 50 will raise and lower the lift arms 28 and 30 about the pins 31 on the upper end portions of the towers 22. The end plates 74,76 on the crossbrace 62 and the external plates 90,90 are both secured about the cut out midportions 60 of the lift arms, 28,30 so as to add strength and support to said midportion of the lift arms.

Figure 4:
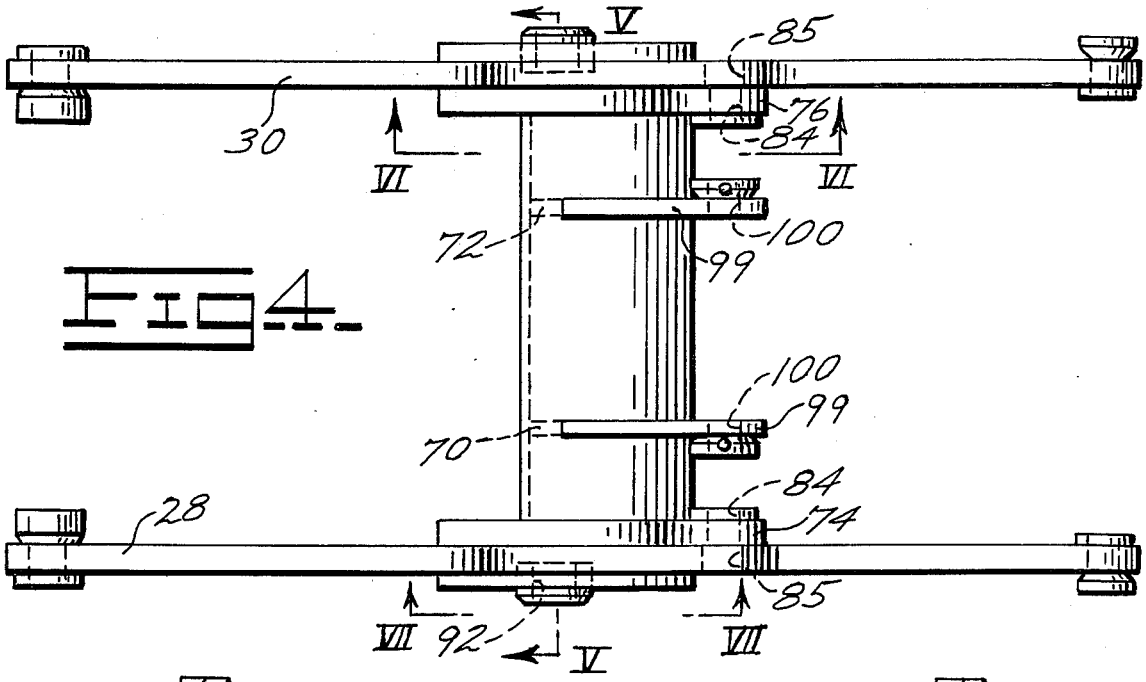
FIG. 4 is a top plan view of the lift arm structure having the improved crossbrace therein.

The crossbrace 62, as can be seen in FIGS. 2, 4 and 8, have brackets 99 rigidly secured to the outer surfaces of the wall 68 of said crossbrace 62, which brackets 99 align with the reinforcing braces 70 and 72 formed on the interior of the crossbrace 62. The brackets 99 have openings 100 passing therethrough, which openings 100 align with openings 97 in the body of the tilt arms 36 and 38 and with the openings 84 in the end plates 74,76 and with openings 85 in the lift arms 28,30. One pin 101 passes through aligned openings 100, 97, 84 and 85 in bracket 99, tilt arm 36, plate 74 and lift arm 28, with a second pin 101 passing through said openings in bracket 99, tilt arm 38, plate 76 and lift arm 30. The tilt arms 36 and 38 have short legs 104 extending transverse to the longitudinal axis thereof to which leg is pinned, as by pin 105, a rod end 106 of the tilt cylinders 52 and 54 with the cylinder ends 107 of said tilt cylinders 52 and 54 being pivotally connected by pins 108 to the extensions 110 of the towers 22. The lower end portions of the tilt arms 36 and 38 are connected by pins 112 to the links 40 and 42, which links, in turn, are pinned by pins 114 to the walls of the cavities formed in the upper rear surface of the bucket 26.

The irregular tubular construction of the crossbrace 62 provides torsional strength to said crossbrace 62. The longitudinal reinforcing web 64 and the stiffening braces 70 and 72 on the inside of the crossbrace 62 support the walls 66,68 of the crossbrace 62 and increase the torsional and lateral stiffness to the crossbrace. With the torsionally stiff and structurally braced walls 66,68 of the crossbrace 62 coupled with the rigidly connected end plates 74 and 76 connected to the lift arms 28 and 30 makes a relatively rigid lift arm structure which will not twist or bend relative to each other. In this way, the bucket 26 can be tilted about the axis of the connecting pins between the lift arms 28,30 and the bucket and can be raised and lowered about the axis of the pins 31 between the lift arms 28,30 and the tower 22 of the vehicle without binding or breaking of the lift and tilt arm structure. The geometry of the linkage is such that the bucket will always be maintained in a constant attitude regardless of the elevated position of the bucket; that is, if the bottom of the bucket is level when it is lifted from the surface, it will remain substantially level throughout the full range of movement of the bucket.

The embodiment of the invention in which an exclusive property or privilege is claimed is defined as follows:

1. In a low clearance front end loader vehicle having a frame, a bucket, and a lift and tilt structure on said frame for moving said bucket, said lift and tilt structure comprising a pair of substantially parallel lift arms pivotally attached at one end to said frame and at the other end to said bucket, a crossbrace extending between and being attached to said lift arms, said crossbrace being tubular in cross section and having a longitudinal web therein for adding torsional strength to said crossbrace, said crossbrace having end plates rigidly secured thereto, said end plates being secured to the inside faces of said spaced lift arms, a lift cylinder pivotally connected between said frame and each of said lift arms, a pair of tilt arms pivotally connected to said lift arms, a tilt cylinder pivotally connected to each of said tilt arms and to said frame, and means connecting said tilt arms to said bucket above the connection of said lift arms to said bucket.

2. In a low clearance front end loader vehicle as claimed in claim 1 wherein said crossbrace has transversely disposed braces therein, and wherein a pair of brackets are supported on said crossbrace in alignment with said transversely disposed braces, each said bracket supporting one end of a pin that provides said pivotal connection for the tilt arms to the lift arms.

3. In a low clearance front end loader vehicle as claimed in claim 1 wherein external plates are rigidly secured to the outside faces of said lift arms in alignment with the end plates on said crossbrace, said external plates and end plates adding rigidity to said lift arms.

4. In a low clearance front end loader vehicle as claimed in claim 1 wherein each said lift arm has a cut out in the midportion thereof and wherein said crossbrace has end plates, said end plates being secured to said lift arms along the edge portions of said cut outs therein.

5. A low clearance front end loader vehicle having a frame, a pair of substantially parallel lift arms pivotally attached to a tower carried by said frame, a bucket pivotally connected to said lift arms, a crossbrace having end plates rigidly connected to each end thereof, said plates being connected to said lift arms, a pair of tilt arms, a pair of brackets carried by said crossbrace, pivot means extending from one of said brackets through each tilt arm and into one of said lift arms for pivotally mounting each tilt arm on said lift arm, means for raising and lowering said lift arms, and means for tilting said tilt arms whereby said bucket is raised and lowered and tilted.

6. A low clearance front end loader vehicle as claimed in claim 5 wherein said crossbrace is a tubular member having at least one longitudinally disposed web and at least two braces extending transverse to said web.

7. A low clearance front end loader vehicle as claimed in claim 6 wherein said brackets are affixed to said crossbrace in alignment with said braces.

8. A low clearance front end loader vehicle as claimed in claim 5 wherein an external plate is affixed to each lift arm in alignment with one end plate of said crossbrace.

9. A low clearance front end loader vehicle as claimed in claim 8 wherein said lift arms have cut outs in alignment with a portion of said external plates and said end plates.

10. In a low clearance front end loader vehicle having a frame, a prime mover carried by said frame, wheels mounted on the frame and driven by the prime mover, a bucket, and a lift and tilt structure for said bucket, said lift and tilt structure comprising a pair of substantially parallel lift arms pivotally attached to a tower carried by said frame and to said bucket, a crossbrace extending between said lift arms and having a first plate at each end connected to one of said lift arms, a second plate connected to the opposite side of each arm with each said second plate and the aligned first plate having aligned apertures for receiving a pin connecting one end of a lift cylinder to each said arm, the other end of said lift cylinder being pivotally connected to said tower, a pair of tilt arms, a pivot extending from each of said tilt arms and being supported at one end by said first plate and the associated lift arm, means carried by said crossbrace for supporting the other end of said last-named pivot, a tilt cylinder extending between said tower and one end of each of said tilt arms, and means connecting the other end of said tilt arms to said bucket.

11. In a low clearance front end loader vehicle as claimed in claim 10 wherein said crossbrace is tubular in cross section and has a web extending longitudinally therein and wherein a pair of braces are formed transverse to said web inside said tube.

12. In a low clearance front end loader vehicle as claimed in claim 11 wherein said means carried by said crossbrace for supporting said pivot is a bracket mounted on said crossbrace.

13. In a low clearance front end loader vehicle as claimed in claim 12 wherein said brackets are aligned with said braces in said crossbrace.

14. In a low clearance front end loader vehicle as claimed in claim 13 wherein said first plates and said second plates bridge a cut out opening in the lower edge of each of said lift arms.

* * * * *